US007337703B2

(12) United States Patent
Sansolo

(10) Patent No.: US 7,337,703 B2
(45) Date of Patent: Mar. 4, 2008

(54) MODULAR BREACHING APPARATUS

(76) Inventor: Arie Sansolo, 19 Harel Street, Ashkelon 78649 (IL)

( * ) Notice: Subject to any disclaimer, the term of this patent is extended or adjusted under 35 U.S.C. 154(b) by 44 days.

(21) Appl. No.: 11/415,170

(22) Filed: May 2, 2006

(65) Prior Publication Data

US 2007/0051234 A1 Mar. 8, 2007

(51) Int. Cl.
*B64D 1/04* (2006.01)

(52) U.S. Cl. ..... 89/1.14; 102/307

(58) Field of Classification Search ..... 89/1.14; 102/306, 307

See application file for complete search history.

(56) References Cited

U.S. PATENT DOCUMENTS 4,408,535 A * 10/1983 Alford ..... 102/305
4,815,384 A * 3/1989 Ringel et al. ..... 102/307
4,856,430 A * 8/1989 Gibb et al. ..... 102/307
5,377,594 A * 1/1995 Alford ..... 102/308

* cited by examiner

*Primary Examiner*—Michael J. Carone
*Assistant Examiner*—Gabriel J Klein
(74) *Attorney, Agent, or Firm*—Dekel Patent Ltd.; David Klein

(57) ABSTRACT

Modular breaching apparatus including a plurality of breaching elements, each breaching element being formed with a groove for receiving therein a flexible explosive element capable of producing an explosive force sufficient for breaching a structure, wherein each breaching element includes a receptacle for placing therein a detonator, an attachment device for attaching to a structure.

12 Claims, 4 Drawing Sheets

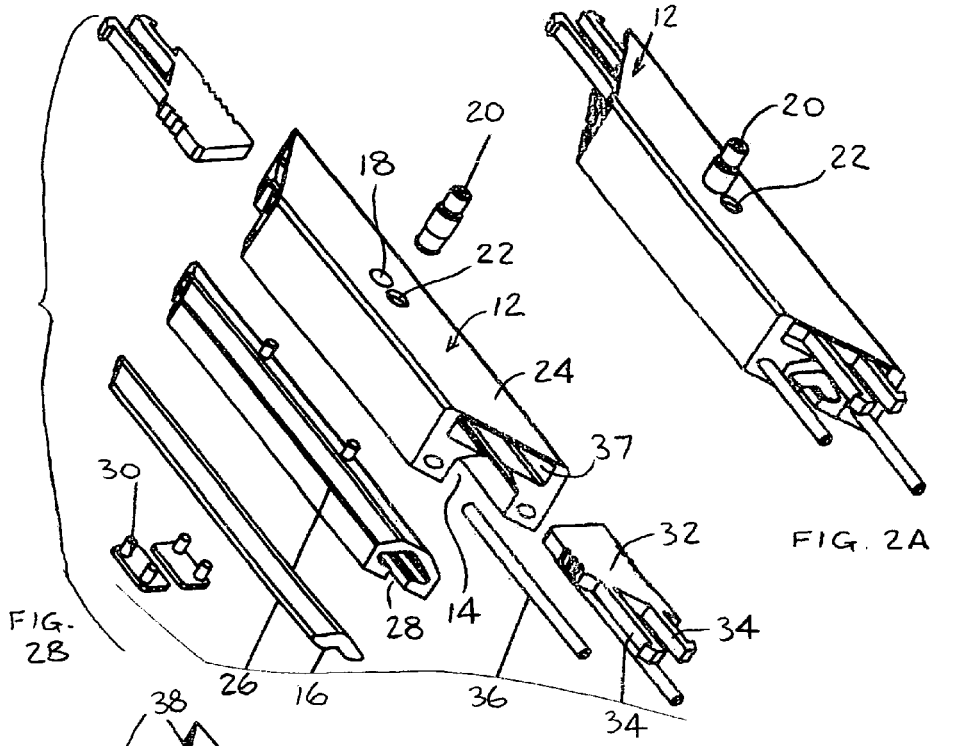
FIG. 2A
FIG. 2B
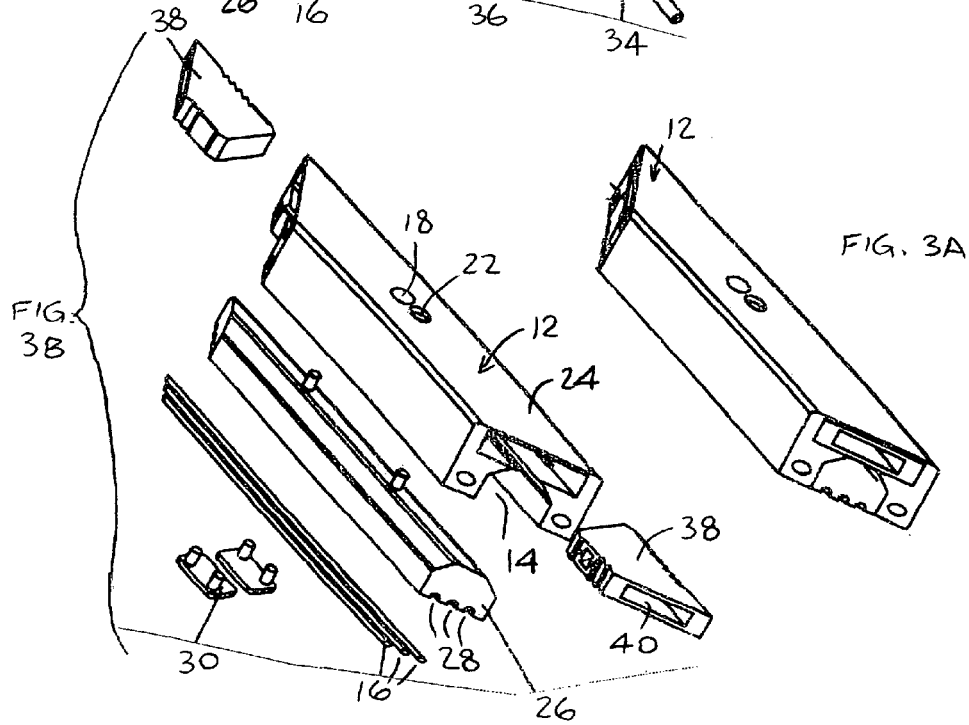
FIG. 3A
FIG. 3B 50
66
64
66

10
12
18
20
22
50

50
60
56
58
52
54
62
66
64

MODULAR BREACHING APPARATUS

FIELD OF THE INVENTION

The present invention relates generally to breaching apparatus, that is, devices for gaining entry by explosive force, and particularly to the field of using explosive material to produce fragment-free openings in hardened structures such as doors or metal containers.

BACKGROUND OF THE INVENTION

Special weapons and tactic (SWAT) teams or other police and military personnel, as well as firefighters, may use breaching apparatus to gain entry into locked and barricaded buildings, where criminals, terrorists, hostages, drug caches, and dangerous fires and the like are located. The situations that may be encountered are so varied that usually such teams must be equipped with a large variety of equipment for overcoming a broad spectrum of problems and obstacles that must be overcome to gain entry. In addition, it is highly desirable to minimize damage to surrounding structure when using explosives to gain entry.

For many years, explosive cutting and explosive entry have relied upon shaped explosive charges as distinct from bulk charges. The shaped charge principle, developed by Charles Munroe at the end of the 19th century, is based on the characteristics of shock waves produced when a shaped explosive is detonated. When an explosive charge is placed against a layer of material, e.g. steel, concrete or stone, the shock waves may be directed by the shape of the explosive material, so as to form twin convergent shock wave fronts. The convergent wave fronts are refracted at the surface of the target and reflected from the opposite surface, whereby tensile forces are generated along the centre plane between the shock wave fronts. The tensile forces, depending on several factors such as the shape of the explosive charge, usually resembling in cross-section a sloped roof or inverted V-shape, the thickness of the target and, of course, the amount of explosive can produce a relatively clear linear cut as opposed to fracturing in the case of bulk explosive charge.

It is also known to use a stemming material in the art of directional blasting. Stemming material such as water or sand is used to fill a portion of the explosive device. The stemming material receives a part of the explosive forces during detonation while the material to be blasted receives another part of the explosive forces. Thus, the stemming material directs the blast towards the target. However, the stemming material adds to the weight of the device.

U.S. Pat. No. 4,905,601 to Gabriel et al. describes a device for explosive entry or cutting a dense material such as concrete. The device comprises a backing element comprising a layer of a substantially incompressible material such as e.g. water or sand. The layer is V-shaped in cross-section, the V-shape defining two legs and a cavity therebetween. An explosive charge is accommodated in the cavity and secured in place. The explosive charge has in cross-section a V-shape conforming to that of the cavity. The layer of the incompressible material may be self-contained or encased by an envelope having a V-shape, generally corresponding to that of the incompressible material.

Some devices have been developed that attempt to diminish the production of fragments. U.S. Pat. No. 6,817,297 to Greene, et al. describes a device that uses a flexible material, preferably in a mostly square shape, having substantially orthogonal grooves scored into one side. An explosive charge, usually in the form of a sheet of explosives, is cut to fit the side opposite the grooves, in substantially the same shape as the grooves, without extending beyond the periphery of the flexible material. An initiating means is connected proximately centrally to the explosive charge so that upon initiation, the grooves shape the explosive effect so that a plurality of petals cantilevered are formed in the target material, substantially between the ends of the grooves, to define a fragment-free opening in the target material.

SUMMARY OF THE INVENTION

The present invention seeks to provide novel breaching apparatus. The breaching apparatus of the present invention may be modularly built from individual breaching elements into many shapes and sizes. One advantage of the modular construction is its compactness and light weight. In the prior art, one single, relatively heavy breaching frame has to be carried by a single person. In contrast, in the present invention, the individual breaching elements may be carried by different persons to make the load lighter and less bulky.

The breaching apparatus of the present invention may be constructed from soft, flexible polymer. This is advantageous over the prior art that uses water as a stemming material, which as mentioned previously, adds to the weight of the device. Another advantage is that the polymer reduces the amount of fragments, and the fragments are small enough in size so as not to cause damage or injury.

There is thus provided in accordance with an embodiment of the invention modular breaching apparatus including a plurality of breaching elements, each breaching element being formed with a groove for receiving therein a flexible explosive element capable of producing an explosive force sufficient for breaching a structure, wherein each breaching element includes a receptacle for placing therein a detonator, an attachment device for attaching to a structure to be breached, and a connector for modular connection to an adjacent breaching element.

Each breaching element may be constructed of a material that disintegrates upon explosion without significant amounts of fragments being given off, such as but not limited to, a flexible polymeric material.

Ends of the breaching elements may be angled (e.g., 45°) such that abutting two adjoining breaching elements with one another in a first orientation forms a 90° angle, and in a second orientation forms a 0° angle. The breaching elements may thus be connected to one another to form a closed frame. A planar breaching element may be attached to an inner perimeter of the frame, the planar breaching element including a flexible explosive element.

The breaching elements may be mounted or affixed to any structure (e.g., doors or buildings) by various attachment devices, such as but not limited to, multiple hook fasteners (e.g., VELCRO), vacuum attachment devices, magnetic fasteners, double-sided adhesive, spikes and the like. The breaching elements may further comprise a fastener for attachment to a robotic arm, for safe remote operation.

BRIEF DESCRIPTION OF THE DRAWINGS

The present invention will be understood and appreciated more fully from the following detailed description, taken in conjunction with the drawings in which:

FIGS. 2A and 2B are simplified pictorial and exploded illustrations respectively of a breaching element of the breaching apparatus of FIG. 1 with an explosive element (e.g., shaped explosive material) and having male connectors;

FIGS. 3A and 3B are simplified pictorial and exploded illustrations respectively of a breaching element of the breaching apparatus of FIG. 1 having female connectors;

DETAILED DESCRIPTION OF EMBODIMENTS

Figure 1:
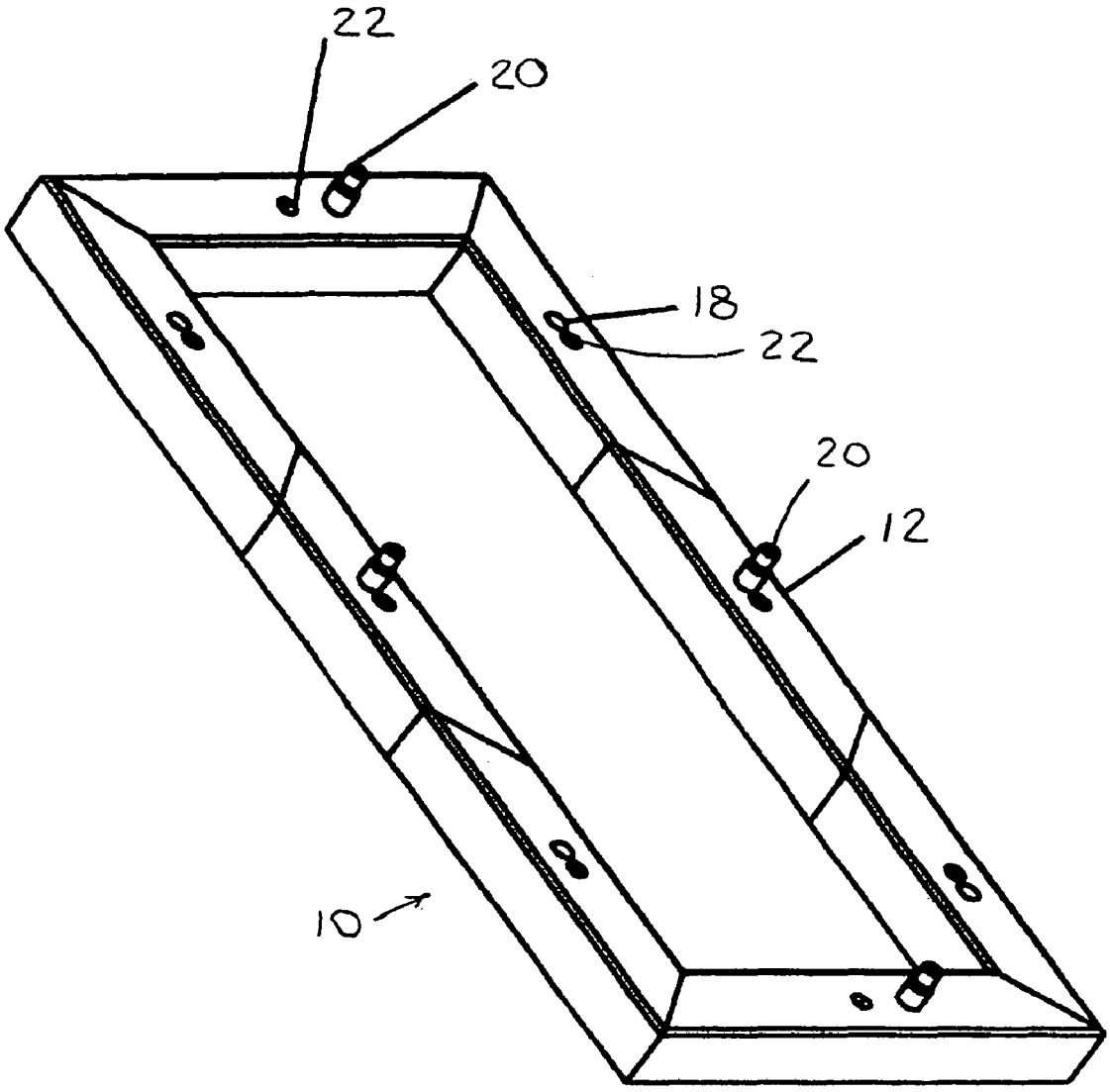
FIG. 1 is a simplified exploded illustration of a modular breaching apparatus, constructed and operative in accordance with an embodiment of the present invention.

Reference is now made to FIGS. 1-3B, which illustrate breaching apparatus 10, constructed and operative in accordance with an embodiment of the present invention.

Breaching apparatus 10 may include a plurality of breaching elements 12. Each breaching element 12 may be formed with a groove 14 (see FIG. 2B) for receiving therein a flexible explosive element 16 (see FIG. 2B) capable of producing an explosive force sufficient for breaching a structure, like a wall or door. The explosive element 16 may include, without limitation, V-shaped shaped explosive material (as in FIG. 3B) or detonating cord (also referred to as demolition cord) (as in FIG. 2B). Each breaching element 12 may include a receptacle 18 (FIGS. 1, 2B and 3B) for placing therein a detonator 20.

Each breaching element 12 may include an attachment device 22 for attaching to a structure to be breached. The attachment device 22 may comprise, without limitation, a multiple hook fastener (e.g., VELCRO), a vacuum attachment device, a magnetic fastener, a double-sided adhesive, a spike (e.g., sharp pins, nails or studs), screws, rivets, glue, mounting hole or a fastener (such as but not limited to, a dimple-shaped depression) for attachment to a robotic arm (not shown) for safe remote operation.

Each breaching element 12 may be constructed of a material (e.g., a flexible polymeric material, such as polyester) that disintegrates (e.g., becomes powder) upon explosion without significant amounts of fragments being given off.

Each breaching element 12 may include a connector for modular connection to an adjacent breaching element 12. Referring to FIG. 2B, breaching element 12 may be constructed, without limitation, of a housing 24 (molded or extruded, for example) with groove 14 formed therein for receiving an elongate catch 26 that has a groove 28 for receiving therein flexible explosive element 16. Pronged fasteners 30 may be used to secure flexible explosive element 16 to elongate catch 26. A pair of male connectors may be provided that include an insert 32 with two resilient tongues 34, with optionally separate pins 36. Insert 32 may fit snugly in a channel 37 formed in housing 24. FIG. 3B illustrates the female connector that mates with this male connector. The female connector may include an insert 38 with a socket 40 formed therein for snappingly receiving therein resilient tongues 34.

Figure 4A:
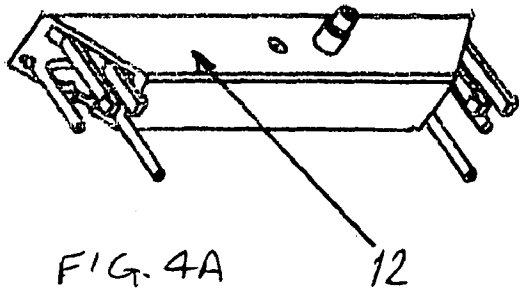
FIGS. 4A and 4B are simplified pictorial and exploded illustrations respectively of a breaching element of the breaching apparatus of FIG. 1 having corner connectors.
Figure 4B:
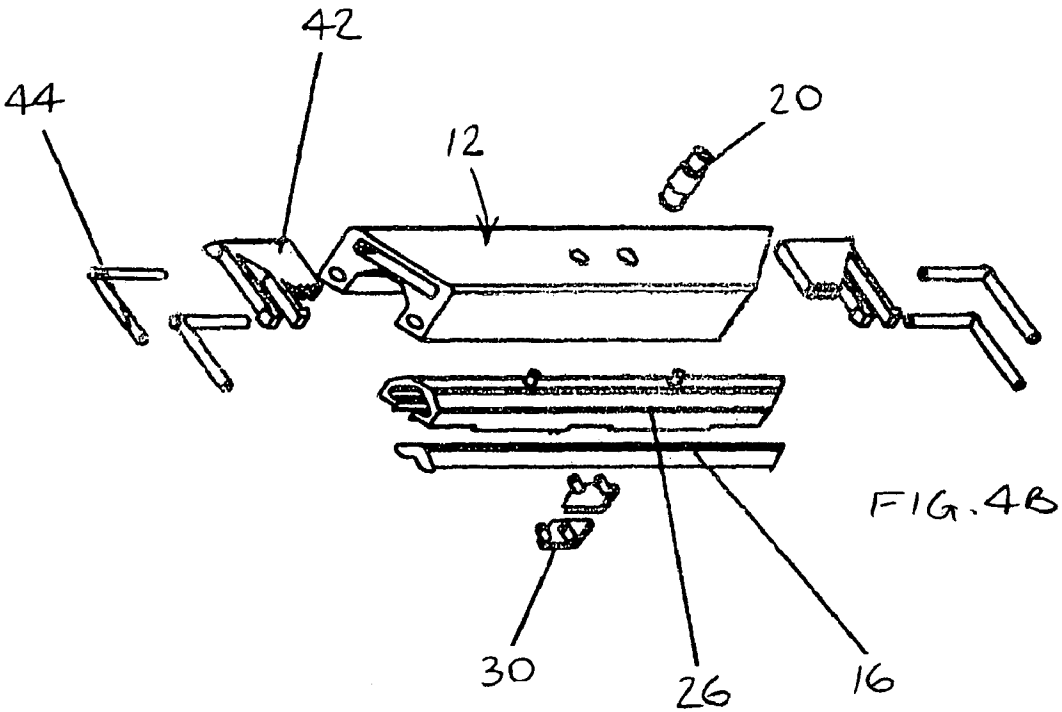

FIG. 4B illustrates a corner connector 42 (constructed with resilient tongues like the male connector of FIG. 2B) with optional corner pins 44.

As seen in FIG. 1, breaching elements 12 may be connected to one another to form a closed frame. Ends of the breaching elements 12 may be angled (e.g., 45°) such that abutting two adjoining breaching elements with one another in a first orientation forms a 90° angle (at the corners of the frame), and in a second orientation forms a 0° angle (along the sides of the frame). It is appreciated that this is only one of many possible arrangements of the partitions and the invention is not limited to this arrangement.

Figures 5A, 5B, 6:
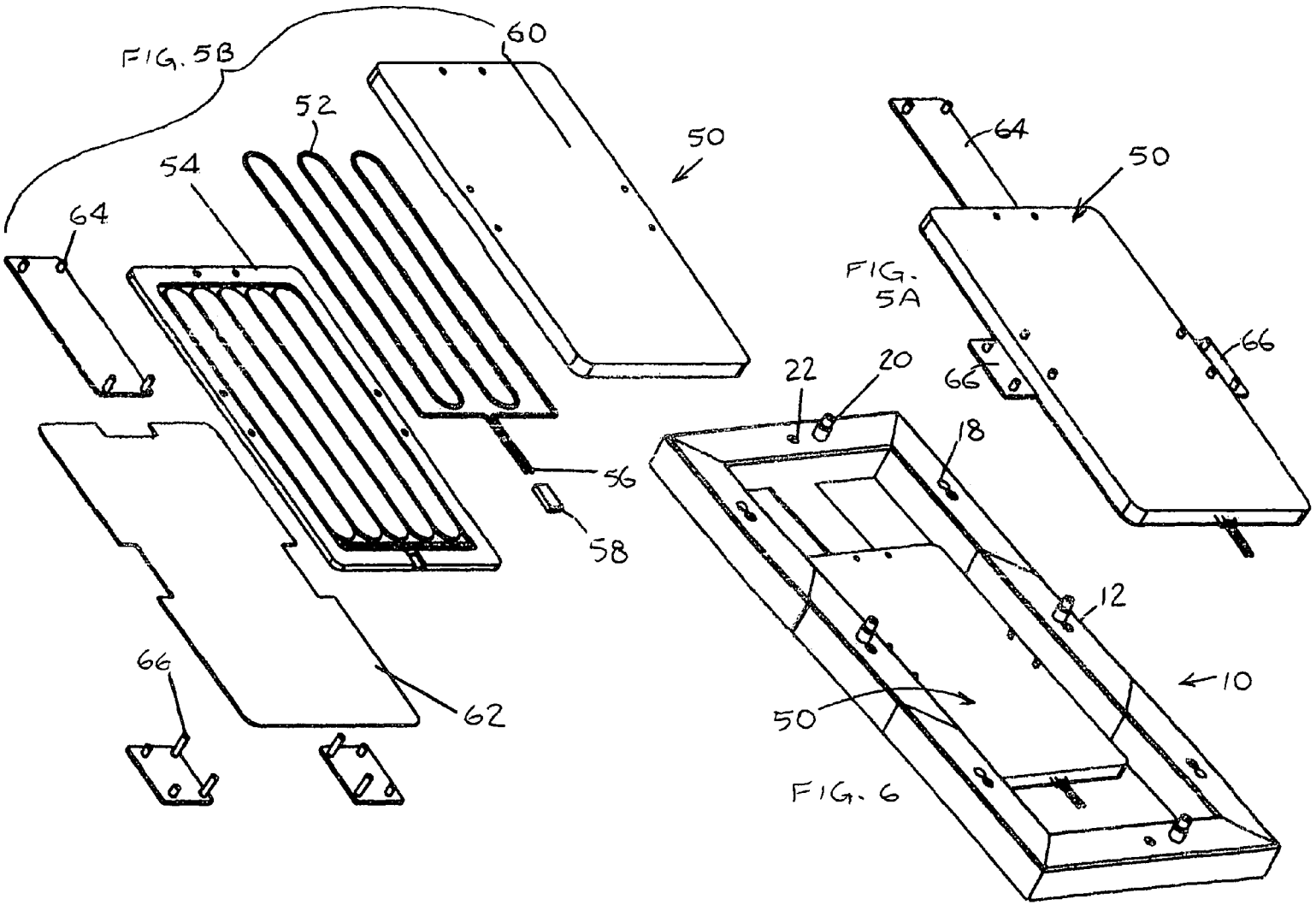
FIGS. 5A and 5B are simplified pictorial and exploded illustrations respectively of a planar breaching element that attaches to the inner perimeter of the breaching apparatus of FIG. 1.
FIG. 6 is a simplified pictorial illustration of the planar breaching element of FIGS. 5A and 5B attached to the breaching apparatus of FIG. 1.

Reference is now made to FIGS. 5A, 5B and 6, which illustrate a planar breaching element 50 that may be attached to an inner perimeter of the frame of FIG. 1. The planar breaching element 50 may include a flexible explosive element 52 wound in any form or pattern on a substrate 54. (Alternatively, the planar breaching element 50 may include any other explosive element, such as but not limited to, a detonator sheet or flexible explosive sheet.) The flexible explosive element 52 may include ends 56 for connection to a detonator 58. The planar breaching element 50 may be sealed with top and bottom covers 60 and 62, respectively. Brackets or other attachment devices 64 and 66 may be provided for securing planar breaching element 50 to the inner perimeter of the frame, as seen in FIG. 6.

The scope of the present invention includes both combinations and subcombinations of the features described hereinabove as well as modifications and variations thereof which would occur to a person of skill in the art upon reading the foregoing description and which are not in the prior art.

What is claimed is:

1. Modular breaching apparatus comprising:

a plurality of breaching elements, each breaching element comprising a housing formed with a groove for receiving therein a flexible explosive element capable of producing an explosive force sufficient for breaching a structure, wherein each breaching element comprises a receptacle for placing therein a detonator, an attachment device for attaching to a structure to be breached, and a connector for modular connection to an adjacent breaching element, wherein said connector comprises a male connector that includes an insert with two resilient tongues, said insert fitting in a channel formed in said housing, and a female connector that mates with said male connector, said female connector including an insert with a socket formed therein for snappingly receiving therein said resilient tongues.

2. The modular breaching apparatus according to claim 1, wherein each breaching element is constructed of a material that disintegrates upon explosion without significant amounts of fragments being given off.

3. The modular breaching apparatus according to claim 1, wherein each breaching element is constructed of a flexible polymeric material.

4. The modular breaching apparatus according to claim 1, wherein ends of the breaching elements are angled 45° such that abutting two adjoining breaching elements with one another in a first orientation forms a 90° angle, and in a second orientation forms a 0° angle.

5. The modular breaching apparatus according to claim 1, wherein said breaching elements are connected to one another to form a closed frame.

6. The modular breaching apparatus according to claim 5, further comprising a planar breaching element attached to an inner perimeter of said frame, said planar breaching element comprising a flexible explosive element.

7. The modular breaching apparatus according to claim 1, wherein said attachment device comprises at least one of a multiple hook fastener, a vacuum attachment device, a magnetic fastener, a double-sided adhesive, a spike, and a fastener for attachment to a robotic arm.

8. Modular breaching apparatus comprising:

a plurality of breaching elements, each breaching element comprising a housing formed with a groove for receiving therein a flexible explosive element capable of producing an explosive force sufficient for breaching a structure, wherein each breaching element comprises a receptacle for placing therein a detonator, an attachment device for attaching to a structure to be breached, and a connector for modular connection to an adjacent breaching element, and wherein each breaching element is constructed of a flexible polymeric material that disintegrates upon explosion without significant amounts of fragments being given off, and wherein ends of the breaching elements are angled at 45° such that abutting two adjoining breaching elements with one another in a first orientation forms a 90° angle, and in a second orientation forms a 0° angle, and wherein said connector for modular connection comprises a male connector that includes an insert with two resilient tongues, said insert fitting in a channel formed in said housing, and a female connector that mates with said male connector, said female connector including an insert with a socket formed therein for snappingly receiving therein said resilient tongues.

9. The modular breaching apparatus according to claim 8, wherein said breaching elements are connected to one another to form a closed frame.

10. The modular breaching apparatus according to claim 9, further comprising a planar breaching element attached to an inner perimeter of said frame, said planar breaching element comprising a flexible explosive element.

11. The modular breaching apparatus according to claim 1, wherein said housing comprises an elongate catch in which is formed the groove for receiving therein said flexible explosive element, and further comprising pronged fasteners that secure said flexible explosive element to said elongate catch.

12. The modular breaching apparatus according to claim 8, wherein said housing comprises an elongate catch in which is formed the groove for receiving therein said flexible explosive element, and further comprising pronged fasteners that secure said flexible explosive element to said elongate catch.

* * * * *